United States Patent [19]

Alfieri

[11] 4,074,432

[45] Feb. 21, 1978

[54] INDEX COVER FOR KNOCK-OUT PUNCH

[76] Inventor: Romeo Alfieri, 336 W. 15th St., Holland, Mich. 49423

[21] Appl. No.: 689,517

[22] Filed: May 24, 1976

[51] Int. Cl.[2] ..... B26F 1/00

[52] U.S. Cl. ..... 30/360; 33/191

[58] Field of Search ..... 30/360, 361, 366, 368; 33/191

[56] References Cited

U.S. PATENT DOCUMENTS

| | | | |
|---|---|---|---|
| 2,526,528 | 10/1950 | Zickler et al. | 33/191 |
| 2,540,861 | 2/1951 | Buchalter | 33/191 |
| 2,936,657 | 5/1960 | Berlin et al. | 33/191 X |

FOREIGN PATENT DOCUMENTS

| | | | |
|---|---|---|---|
| 50,669 | 11/1940 | France | 33/191 |
| 971,828 | 8/1950 | France | 33/191 |
| 142,641 | 5/1920 | United Kingdom | 33/191 |

OTHER PUBLICATIONS

"American Machinist," Jan. 13, 1958, vol. No. 102, Issue No. 1, p. 126.

*Primary Examiner*—James L. Jones, Jr.
*Assistant Examiner*—J. T. Zatarga
*Attorney, Agent, or Firm*—Price, Heneveld, Huizenga & Cooper

[57] ABSTRACT

An index cover for a knock-out punch includes a cylindrical body adapted to snugly fit over a die of a knock-out punch. The cover includes at least a pair of indexing projections extending outwardly from the periphery of the body spaced at approximately 90° intervals to permit accurate centering and locating of the die. The cover may be injection molded of a thermoplastic material and brightly colored to facilitate its use.

9 Claims, 3 Drawing Figures

INDEX COVER FOR KNOCK-OUT PUNCH

BACKGROUND OF THE INVENTION

The present invention relates to an indexing cover for knock-out punches.

Knock-out punches of the type disclosed in U.S. Pat. No. 2,221,904 issued Nov. 19, 1940 to J. H. Abramson et al are in common usage. Such punches are frequently used by electricians to form openings or enlarging existing openings in circuit cabinets, panels, chassis or junction boxes. When used for enlarging existing openings, the knock-out punch cannot be easily centered in or aligned with respect to the opening. Although some existing metal punches include scribe marks on the cylindrical side wall of the upper die member, such marks formed in the steel body are not readily visible under ambient light conditions.

Also on construction sites, the electrician is frequently confronted with relatively low, ambient light conditions or areas of limited access making it even more difficult to align a knock-out punch for proper location of an aperture formed thereby.

SUMMARY OF THE INVENTION

It is the purpose of the present invention to provide an index cover which readily fits over a die member of a knock-out punch and provide indexing projections spaced at predetermined intervals to provide readily visible indexing projections which also can be tactually located under very low light levels and areas of limited access.

These and other objects of the present invention, its features and advantages will best be understood by reference to the following description thereof in conjunction with the drawings in which:

DETAILED DESCRIPTION OF THE PREFERRED EMBODIMENT

Figure 3:
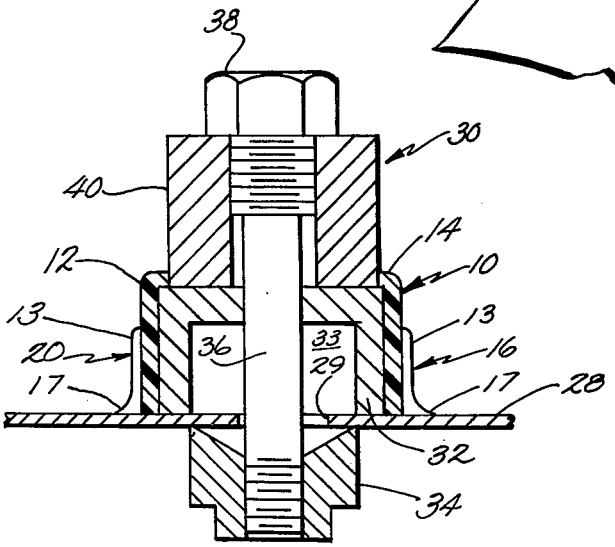
FIG. 3 is a fragmentary cross-sectional of the apparatus taken along the sectional lines III-III of FIG. 2.

Referring now to the Figures there is shown the preferred embodiment of an indexing cover 10 of the present invention. The cover includes a cylindrical body 12 having an inwardly projecting circular lip 14 extending around the top thereof. An aperture 15 is thus formed in the top of the cover to permit normal operation of the knock-out punch. The bottom of cover 10 is open such that it can be positioned over the die 32 of a knock-out punch as seen in FIG. 3.

Extending outwardly from the body 12 is a plurality of projections 16, 18, 20 and 22 spaced at predetermined intervals which are 90° in the preferred embodiment. These projections extend radially outwardly from the axis of the cylindrical body 12 and are integrally formed. Each of the projections includes a narrow upper portion 12 and an enlarged and pointed tip 17 at the lower end which is flush with the bottom of the body.

In the preferred embodiment the cover was manufactured by injection molding using a resilient polymeric material such a polyvinyl chloride or other vinyl polymer which can be brightly colored to provide a very visible indexing cover easily utilized under relatively low ambient light conditions. The projections 16, 18, 20 and 22 with their pointed tips 17 further provide mechanical projections which can be utilized for aligning the cover when mounted on a knock-out punch as described below by touch even where the existing light level does not permit visual alignment.

In use, the cover 10 is positioned over the upper die 32 of a knock-out punch having a central cavity 33 into which a lower cutting die 34 can be projected. A bolt 36 passes through a plate 28 into which an aperture is to be cut by the knock-out punch through an existing aperture 29. The aperture 29 need not be of exact dimension corresponding to the diameter of bolt 36 inasmuch as the indexing cover of the present invention eliminates such a requirement. Frequently, in fact, the knock-out punch is used for enlarging existing apertures in which case the bolt 36 is not useful for providing the desired centering or the location of the knock-out punch. Thus for example in the embodiment as seen in FIG. 3, it is desired to enlarge an existing aperture 29 significantly off center to the left as seen in FIG. 3.

Figure 1:
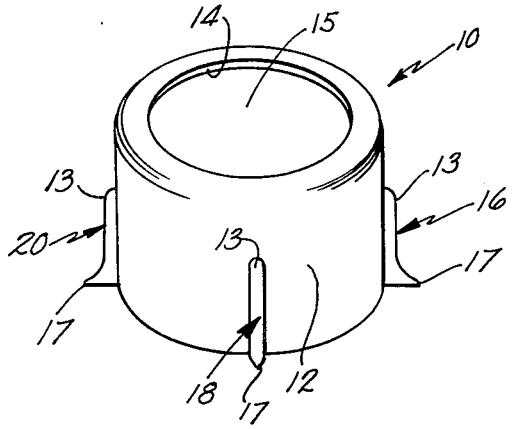
FIG. 1 is a perspective view of the preferred embodiment of the present invention.
Figure 2:
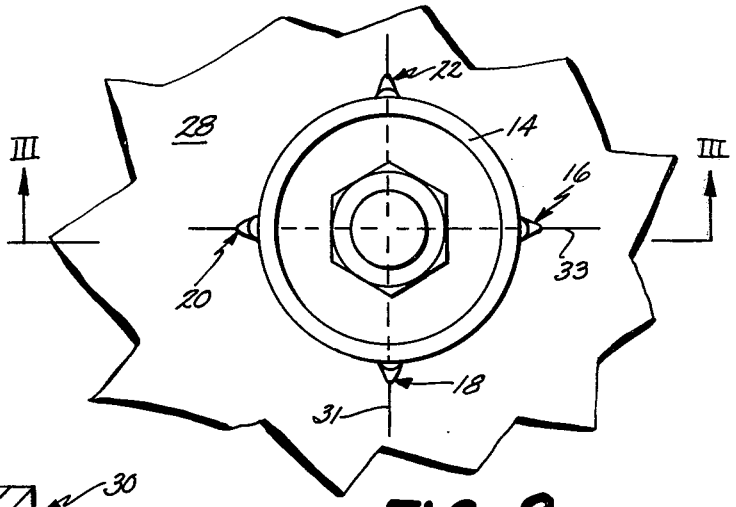
FIG. 2 is a plan view in fragmentary form showing the use of the present invention in conjunction with a conventional knock-out punch.

The bolt 36 includes a head 38 and is threaded at the lower end to threadably fit within the cutting die 34 which is similarly threaded. Also a nut 40 is threaded to the upper end of bolt 38 and fits within the central opening 15 within the lip 14 of cover 10. In use, the nut 40 is tightened forcing the bolt 38 upwardly until the cutting die 34 pierces the sheet metal plate 28 and cuts a new aperture centered by means of the indexing cover. As best seen in FIG. 2, cross hairs 31 and 33 can be scribed on the plate 28 if desired, the projections 16, 18, 20 and 22 aligned therewith for providing the desired location of the die regardless of the existence or position of a previous aperture.

It will be appreciated by those skilled in the art that the indexing cover 10 is made in a complete set of different sizes, one for each of the many standard knock-out punch dies. Also it will be appreciated that the indexing projections need not be spaced at 90° intervals but can be placed at other relative angular positions as desired for any given application. These and other modifications to the preferred embodiment of the invention will, however, fall within the spirit and scope of the present invention as defined by the appended claims.

The embodiments of the invention in which an exclusive property or privilege is claimed are defined as follows:

1. A removable indexing cover for use on a knock-out punch comprising a relatively thin-walled resilient, open ended body having a first end and a second end and shaped to fit snugly over the outer periphery of a cutting die associated with the knock-out punch, said body integrally including at least a pair of outwardly and longitudinally extending indexing projections having a first end spaced downwardly from said first end of said body and a second end flush with said second end of the body and extending outwardly a greater distance than said first end, said second end of said projections defining a pointed tip, and wherein said projections are spaced at a predetermined angular relationship from each other to provide means for aligning the knock-out punch on an object.

2. The apparatus as defined in claim 1 wherein said indexing cover is generally cylindrical and includes an inwardly projecting lip at said first end.

3. The apparatus as defined in claim 2 wherein said indexing projections are spaced at 90° intervals.

4. The apparatus as defined in claim 3 wherein said indexing cover includes four equally spaced indexing projections.

5. The apparatus as defined in claim 4 wherein said indexing cover is manufactured of a material having a bright color.

6. The apparatus as defined in claim 5 wherein said indexing cover is molded of a thermoplastic material.

7. A removable indexing cover for use on a knock-out punch comprising cylindrical body made of a resilient polymeric material and including a first end and a second end, an inwardly projecting circular lip at said first end of said body and a plurality of equally spaced indexing projections extending radially outwardly from the exterior surface of said body and extending longitudinally away from said first end of said body from a position spaced from said lip to said second end of said body, each of said projections extending radially outwardly to define a pointed tip at said second end of said body, said body having an interior surface shaped to fit over a die of a knock-out punch.

8. The apparatus as defined in claim 7 wherein said material is brightly colored.

9. The apparatus as defined in claim 7 wherein said projections are spaced at 90° intervals.

* * * * *